US011329383B2

(12) United States Patent
Canete Cabeza et al.

(10) Patent No.: US 11,329,383 B2
(45) Date of Patent: May 10, 2022

(54) ULTRA-LOW-PROFILE TRIAXIAL LOW FREQUENCY ANTENNA FOR INTEGRATION IN A MOBILE PHONE AND MOBILE PHONE THEREWITH

(71) Applicant: PREMO, SA, Campanillas (ES)

(72) Inventors: Claudio Canete Cabeza, Benalmadena (ES); Francisco Ezequiel Navarro Perez, Barcelona (ES); Jorge Rodriguez, Malaga (ES); Sergio Cobos Reyes, Malaga (ES); Antonio Rojas Cuevas, Malaga (ES)

(73) Assignee: PREMO, SA, Campanillas (ES)

( * ) Notice: Subject to any disclaimer, the term of this patent is extended or adjusted under 35 U.S.C. 154(b) by 35 days.

(21) Appl. No.: 16/767,273

(22) PCT Filed: Nov. 8, 2018

(86) PCT No.: PCT/EP2018/080658
§ 371 (c)(1),
(2) Date: May 27, 2020

(87) PCT Pub. No.: WO2019/105710
PCT Pub. Date: Jun. 6, 2019

(65) Prior Publication Data

US 2020/0328512 A1 Oct. 15, 2020

(30) Foreign Application Priority Data

Nov. 29, 2017 (EP) ..... 17382805

(51) Int. Cl.
*H01Q 7/00* (2006.01)
*H01Q 7/06* (2006.01)
*H01Q 1/22* (2006.01)

(52) U.S. Cl.
CPC ..... *H01Q 7/06* (2013.01); *H01Q 1/2208* (2013.01)

(58) Field of Classification Search
CPC .... H01Q 1/2208; H01Q 1/2216; H01Q 21/24; H01Q 21/28; H01Q 7/06
See application file for complete search history.

(56) References Cited

U.S. PATENT DOCUMENTS

2005/0083242 A1 4/2005 Yagi et al.
2011/0273559 A1* 11/2011 Yagitani ..... G01R 29/0871 348/135

(Continued)

FOREIGN PATENT DOCUMENTS

DE 102015104993 A1 * 10/2016 ..... H01Q 7/06
DE 102015104993 A1 10/2016

(Continued)

OTHER PUBLICATIONS

International Search Report and Written Opinion for Corresponding International Application No. PCT/EP2018/080658 (11 Pages) (dated Dec. 20, 2018).

(Continued)

*Primary Examiner* — Thien M Le
(74) *Attorney, Agent, or Firm* — Lucas & Mercanti, LLP

(57) ABSTRACT

An antenna including a magnetic core made of a soft-magnetic non-electro conductive material, including four corner protuberances defining two orthogonal winding channels around the magnetic core; X-winding (DX), Y-winding (DY) and Z-winding (DZ) of conductive wire orthogonal to one another wound around the magnetic core, wherein the antenna further has a first soft magnetic sheet attached superimposed on said four corner protuberances of the magnetic core providing a limiting edge for the Z-winding (DZ), so that an increase of the sensitivity of the Z-winding (Continued)

(DZ) and a reduced thickness of the antenna in the Z-axis (Z) direction are obtained.

18 Claims, 6 Drawing Sheets

(56) References Cited

U.S. PATENT DOCUMENTS

| | | | | |
|---|---|---|---|---|
| 2013/0033408 | A1* | 2/2013 | Miki | H01Q 25/00 343/788 |
| 2013/0069760 | A1* | 3/2013 | Lickfelt | H04B 17/29 340/5.61 |
| 2016/0021506 | A1* | 1/2016 | Bonge, Jr. | H04W 4/027 717/173 |
| 2016/0211579 | A1 | 7/2016 | Rojas et al. | |
| 2017/0282858 | A1 | 10/2017 | Sass | |
| 2017/0291579 | A1 | 10/2017 | Miyazawa | |
| 2017/0320465 | A1 | 11/2017 | Lin | |

FOREIGN PATENT DOCUMENTS

| | | | | |
|---|---|---|---|---|
| EP | 2911244 | A1 | 8/2015 | |
| EP | 3166180 | A1 * | 5/2017 | H01Q 7/08 |
| EP | 3166180 | A1 | 5/2017 | |
| ES | 2460368 | A1 | 5/2014 | |
| JP | 4007332 | B2 | 11/2007 | |
| JP | 2017123547 | A | 7/2017 | |
| WO | 2014088954 | A1 | 6/2014 | |
| WO | WO-2014088954 | A1 * | 6/2014 | H01F 1/344 |
| WO | 2017076959 | A1 | 5/2017 | |
| WO | 2017183933 | A1 | 10/2017 | |
| WO | WO-2017183933 | A1 * | 10/2017 | H01Q 1/32 |

OTHER PUBLICATIONS

International Preliminary Report on Patentability for Corresponding International Application No. PCT/EP2018/080658 (27 pages) (dated Oct. 29, 2019).

* cited by examiner

ULTRA-LOW-PROFILE TRIAXIAL LOW FREQUENCY ANTENNA FOR INTEGRATION IN A MOBILE PHONE AND MOBILE PHONE THEREWITH

CROSS REFERENCE TO RELATED APPLICATION

This Application is a 371 of PCT/EP2018/080658 filed on Nov. 8, 2018, which claims priority of European Patent Application No. 17382805.4 filed Nov. 29, 2017, both of which are incorporated herein by reference.

TECHNICAL FIELD

The present invention is related to an ultra-low-profile triaxial low frequency antenna for integration in a mobile phone and mobile phone therewith.

The expression ultra-low-profile is referred to an antenna having an extreme low thickness, in a range smaller than 2 mm, and preferable less than 1.65 mm, specially adapted for being included in a mobile phone. Being said antenna triaxial allows the reception of signals from any direction and/or the transmission of signals to all directions simultaneously. This kind of antennas include a magnetic core and three orthogonal windings surrounding said magnetic core.

Low frequency is typically the designation for radio frequencies in the range of 30 kHz to 300 kHz.

The present invention refers to an antenna specially designated to be small in size, to have a thickness small enough to permit its integration in a mobile phone, and to withstand the requirements of a mobile phone, for example the bending resistance.

As will be understood said antenna can be also integrated in other portable devices in which the thickness is, a relevant design parameter and a limitation for the integration of elements therein, as for example tablets, cards-key, etc.

STATE OF THE ART

Many triaxial antennas are known in the state of the art, and the problem of reducing its high has been also faced by many different documents, producing solutions directed to RFID Keyless Entry Systems with 3D Antennas to be assembled onto a PCB in a key fob, and even solutions for 3D sensing in Card type key fobs, but no monolithic (single core) solution has been presented for smart phones that keeps the sensitivity, ultra-low-profile, limited area and flexibility requirements necessary for its integration within a mobile phone.

For example, document US2005083242A1 describe a triaxial antenna having a low-profile, in this case using a magnetic core having three orthogonal winding channels there around. In this example the magnetic core has been shaped including a perimetric recess which defines the winding channel for the perimetric Z-winding. This recess cannot be produced by moulding in an ultra-low-profile magnetic core because the production of said core will require a complex mould with at least four independent movable parts and a magnet core of this size will probably broke during the unmoulding operations. This recess cannot be machined because the magnetic core will also be broken during said machining operation.

Document US2013033408A1 describe a flat triaxial antenna similar to the antenna described on said previously discussed document US2005083242.

In this document US2013033408A1 the magnetic core is obtained by the attachment of two independent flat magnetic parts, each easily producible by standard moulding operations, producing by its combination a multi-layer magnetic core with a complex shape including winding channels also for the perimetric Z-winding.

In this solution the windings are wound surrounding said multi-layer magnetic core, and both parts of the magnetic core need to include notches for the X-winding and for the Y-winding. In the regions where the Z-winding is overlapped with the X-winding or the Y-winding, said notches prevent the magnetic core to surround the Z-winding reducing the surface of magnetic core facing the Z-winding and therefore producing a limited Z-winding sensitivity.

Furthermore, in this solution described on US2013033408A1 each independent flat magnetic part of the magnetic core includes cantilever regions on each corner being said cantilever regions of one part of the magnetic core spaced apart from the cantilever regions of the other part of the magnetic core defining in-between the Z-winding channel. Being both parts of the magnetic core attached to each other and surrounded by the X-winding and by the Y-winding, the distance between said cantilever regions, in the Z-axis direction, is smaller than the height of the X-winding and the Y-winding in the Z-axis direction, producing a Z-winding with a limited height in the Z-axis direction, and therefore further reducing the Z-winding sensitivity.

Denso document JP4007332 claims an integrated low-profile antenna, but is not monolithic, not for LF and the solution proposed is low-profile but extended in the other dimensions.

While there are plenty of keyless entry systems and antennas for keyless entry systems described (US2017320465; US2017291579; US2017282858; JP2017123547) and specific inventions of triaxial monolithic antennas have been described for key fobs in keyless entry systems (like Premo patents EP2911244; WO2013EP03888; WO2017076959; ES2460368). Other solutions of triaxial monolithic antennas are described for example by companies TDK, Epcos, Sumide, Toko, Neosid.

None of them solve the challenges to integrate the product in a Smartphone (Profile lower than 1.65 mm, area lower than 14×14 mm withstanding bending test and with a minimum sensitivity over 50 mV/Amv in Z-axis.

The very tight mechanical constrains makes that the Z-axis has very limited sensitivity. In order to maximize Z sensitivity, estate of the art low profile LF antennas are air coils or flat coreless coils that are quite wide in terms of area. When the overall available area is restricted, the Z Magnetic Induction is unable to induce a minimum voltage in the air, so a relatively high effective magnetic permeability is needed.

There are low profile solutions in the market for Card Type keyless entry key fobs, most of the use discrete low-profile components, typically two identical low-profile antennae for X and Y axis and either a flat careless coil or a small low-profile Z-axis coil made with a ferrite drum core. None of these solutions are suitable to be integrated in a Smartphone. Even with the use of low profile nanocrystalline cores or amorphous cores like the ones described by Hitachi Metals, the total surface target is not met.

Other documents are known which have the Z-winding wounded around, without including said Z-winding in a perimetric recess of a monolithic magnetic core, but this solution does not provide a good sensitivity of the Z-winding over 50 mV/Amv.

Therefore, the cited documents, and other similar documents, do not provide a solution which could be miniaturized in order to provide an ultra-low-profile antenna having a good sensibility in the Z-winding.

BRIEF DESCRIPTION OF THE INVENTION

The present invention is directed, according to a first aspect of the invention, to an ultra-low-profile triaxial low frequency antenna for integration in a mobile phone.

The inclusion of a triaxial low frequency antenna in mobile phones requires the reduction of the thickness of said antenna maintaining its performance and without increasing the other dimensions thereof. Also bending resistance of the antenna has to be improved.

The proposed ultra-low-profile triaxial low frequency antenna includes, as known in the state of the art:

- a magnetic core, made of a soft-magnetic non-electro conductive material, including four corner protuberances defining two orthogonal winding channels around the magnetic core;
- X-winding, Y-winding and Z-winding of conductive wire orthogonal to one another wound around X-axis, Y-axis and Z-axis orthogonal to each other surrounding said magnetic core, the X-winding and the Y-winding being arranged in said two winding channels of the magnetic core and the Z-winding being arranged surrounding the four corner protuberances, such than when an electromagnetic field cross over the mentioned X- Y- and Z-windings (DX, DY, DZ), an electric potential is generated between each wire ends according to the faraday law;

wherein each of the X-, Y- and Z-windings has a conductive wire entry and a conductive wire exit connected to a respective connection terminal.

An expert will be aware that said construction will also generate, when a current circulates through the mentioned X- Y- and Z-windings, electromagnetic fields with electromagnetic field vectors coaxial with the axes of each of the windings.

The described features provide a triaxial antenna which can be optimized for a low frequency range of signals, preferably in the range of 30 kHz to 300 kHz.

Each one of said four corner protuberances will include channel limiting edges which will be facing and spaced from other channel limiting edges of an opposed corner protuberance. Said two facing channel limiting edges define there between one winding channel and will contain the X-winding or the Y-winding wound on said winding channel, allowing an automatic precise wounding and preventing an accidental un-wounding.

The Z-wounding can be automatic wounded using provisional removable limiting edges creating a provisional winding channel, The proposed ultra-low-profile triaxial low frequency antenna further comprises following features which are not known in the state of the art.

A first soft-magnetic sheet is placed perpendicular to the Z-axis and is attached superimposed on flat faces of the four corner protuberances of the magnetic core, said flat faces being perpendicular to the Z-axis and protruding from the winding channels in a side facing the first soft-magnetic sheet, said winding channels being partially confined between the magnetic core and the first soft-magnetic sheet becoming winding tunnels, and the first soft-magnetic sheet providing a limiting edge for the Z-winding. More in detail said first soft-magnetic sheet is attached to flat faces of the corner protuberances, said flat faces being perpendicular to the Z-axis and protruding from the winding channels defined between said four corner protrusions in its side facing the first soft-magnetic sheet.

Said winding channels are partially confined between the magnetic core and the first soft-magnetic sheet becoming winding tunnels.

Said first soft-magnetic sheet is bigger than the magnetic core in the X-axis and in the Y-axis directions, creating a cantilevered region which increases its exposed surface, covers at least partially and preferably completely, the Z-winding and creates said limiting edge offering a great surface perpendicular to the magnetic field generated by the Z-wounding increasing its sensitivity in the Z-axis. According to a preferred embodiment said configuration, or the additional configurations described on this document, provides the Z-winding with sensitivity over 50 mV/Amv.

The sensitivity of the Z-winding does not depend on the thickness of the first soft-magnetic sheet but on its exposed surface, therefore said first soft-magnetic sheet can be as thin as possible, contributing to reduce the total thickness of the antenna. Preferably said first soft-magnetic sheet will be thinner than 0.1 mm, or more preferably thinner than 0.05 mm.

Optionally said first soft-magnetic sheet could have a toroidal shape creating a hole in the central region of the first soft-magnetic sheet. Adapting the shape, size and position of said hole the sensitivity, the quality factor and inductance of each X-, Y- and Z-windings of the antenna can be controlled, adapted or optimized.

A magnetic core small enough to be integrated in a mobile phone (limitation of thickness indicated above lower than 1.65 mm) will have a very reduced total thickness, on which sides no Z-winding channel recess can be included by a machining process of the magnetic core without producing its breakage or weakening.

Also, the fabrication of a magnetic core including said Z-winding recess by an injection process will be difficult to achieve, requiring at least a complex mould including four partial moulds to create such complex shape, which in this size is very difficult to achieve.

This limitation has been overcome by the combination of a magnetic core of similar constitution with the first soft-magnetic sheet, creating said limiting edge which replaces the Z-winding channel recess, and allows an additional reduction of the thickness of the magnetic core.

An additional benefit of the proposed invention is that the combination of the magnetic core and the first soft-magnetic sheet, attached together, for example by adhesive, have a better behaviour in front of bending, because the small thickness of both elements allows its independent bending and relative displacement, reducing the total stress.

According to an additional embodiment of the invention each of the four corners protuberances of the magnetic core include an extension tab perpendicular to the Z-axis, defining along with said limiting edge a Z-winding channel housing said Z-winding, and further increasing the magnetic performance on the Z-winding.

Said extension tabs can be easily produced together with the magnetic core, for example using a simple moulding process in a mould with only two partial moulds.

According to this embodiment, said extension tab and/or the limiting edge of the first soft-magnetic sheet can extend beyond the projection of the Z-winding in the Z-axis direction, increasing the exposed surface and contributing to increase the magnetic field of the magnetic core in the Z-axis, improving the Z-winding sensibility.

As an alternative embodiment the ultra-low-profile triaxial low frequency antenna proposed includes a second soft-magnetic sheet also perpendicular to the Z-axis and also attached superimposed on said four corner protuberances of the magnetic core, but in opposition to the first soft-magnetic sheet, namely on an opposite side of the magnetic core.

The magnetic core will be then confined between the first and second soft-magnetic sheets, and said second soft-magnetic sheet will define, along with the limiting edge of the first soft-magnetic sheet, a Z-winding channel housing said Z-winding.

This configuration will be also thin in the Z-axis direction and easy to produce.

In this case is also contemplated that said first soft-magnetic sheet and/or said second soft-magnetic sheet extend beyond the projection of the Z-winding, contributing to increase the exposed surface and therefore the magnetic field of the magnetic core in the Z-axis.

According to an additional embodiment of the invention each transversal section of the Z-winding, made in a plane coincident with the Z-axis, has a thickness in the Z-axis direction lower than its dimension in the X-axis or in the Y-axis direction. This feature reduces the thickness of the Z-winding without reducing the performance of the Z-winding.

The thickness of the antenna in the Z-axis direction is preferably equal or less than 1.65 mm, which is the maximum thickness for an element which can be included in a regular mobile phone.

The extension of the antenna in the X-axis and in the Y-axis, directions is preferably equal or less than 196 $mm^2$. As a preferred embodiment this size is 14 mm×14 mm.

Preferably the magnetic core is a high-density injected ferrite core, and the first soft-magnetic sheet is a tape cast ferrite sheet, also the second soft-magnetic sheet can be a tape cast ferrite sheet. Preferably the magnetic core is an injected ferrite core of a Nickel Zinc alloy or of a Manganese Zinc alloy.

The high-density ferrite core can be injected in a mould, allowing a precise shaping of the corner protuberances and the winding channels, and optionally also the shaping of the extension tab. In a preferred embodiment the magnetic core is made with a Nickel Zinc alloy or with a Manganese Zinc alloy, providing a non-electric-conductive magnetic core with an optimal bending resistance and magnetic permeability.

Also, the first soft-magnetic sheet made of a tape cast ferrite provides a good bending resistance and magnetic permeability, and at the same time allows its production with a reduced thickness.

The connection terminals stated above are attached to said tabs that include in the side opposed to the Z-winding channel, a configuration for receiving two parallel terminals obtained for example from extensions of a lead-frame.

The connection terminals stated above are attached to the extension tabs, each extension tab including, in a side opposed to the Z-winding channel, a terminal receiving configuration adapted for receiving two parallel terminals deriving from a lead-frame.

As an alternative, said connection terminals can be attached to said first soft-magnetic sheet which will include, in a side opposed to the Z-winding, a terminal receiving configurations where the connection terminals are attached.

Whatever the element in which the connection terminals are attached to, said terminal receiving configurations will be preferably eight in number, two coincident with each corner protuberance, comprising two orthogonal walls and a spacing wall defining said two terminal receiving configurations where semi-arrow end configurations of the terminal are seated.

Said orthogonal walls and said spacing wall will have, in a preferred embodiment, a thickness of 0.1 mm in the Z-axis direction, and the connection terminal housed therein will have also a thickness of 0.1 mm the Z-axis direction.

So, when the terminal receiving configurations are included in the magnetic core, in positions coinciding with the corner protrusions, said terminal receiving configurations will be in the outer side of the extension tabs, and when the terminal receiving configurations are included in the first-soft-magnetic sheet, the terminal receiving configurations will be on the reverse of the area of the first soft-magnetic sheet attached to the corner protuberances.

As a preferred embodiment, each terminal receiving configurations is adjacent to a wire retention projection of the magnetic core or of the first soft-magnetic sheet wherein one end of each wire constitutive of the X-winding, Y-winding or Z-winding is wound around.

Each connection terminal retained on each terminal reception configuration will be therefore in contact with said end of a wire wound around the wire retention projections, defining an electric connection between them. Both elements can be welded together by heat, compression or by laser-welding.

The antenna will also include an over-moulding of an electro-insulant material, for example of epoxy material, Only the connection terminals will be partially not covered by said electro-insulant material.

Said connection terminals can be bended against the electro-insulant material, defining connection terminals overlapped to the over-moulded casing of the antenna.

According to an embodiment of this invention the magnetic core shape is at least partially defined by stepped configurations, some of said stepped configurations having a height of 0.1 mm or less. It is to say that the magnetic core has been produced with a high-resolution process, or with a high precision, allowing shaping stepped configurations of only 0.1 mm or less.

The present Ultra-low-profile triaxial low frequency antenna can be therefore produced as follows.

In a first step a magnetic core including the above described corner protuberances is produces, preferably by a mould injection process and with a high-density ferrite material, or a high-density ferrite material made of a Nickel Zinc alloy or of a Manganese Zinc alloy.

In a second step a thin first soft-magnetic sheet is produced, preferably using a tape cast process and using a ferrite material.

In a third step two independent conductive wires are separately wound around the magnetic core, in a winding channels defined between the corner protuberances, creating an X-winding and a Y-winding. A third independent conductive wire is wound around the four corner protuberances of the magnetic core generating a Z-winding.

In a fourth step the first soft-magnetic sheet is attached to the magnetic core, for example by adhesive, putting the first soft-magnetic sheet simultaneously in contact with the four corner protuberances.

In a fifth step said attachment is integrated in a lead frame which include the connection terminals.

In a sixth, step the ends of the conductive wires constitutive of the X-, Y- and Z-windings are welded to the connection terminals.

In a seventh step the antenna is over-moulded with an electro-insulant material, and the connection terminals are detached from the lead frame.

As will be understood the fourth steps can be produced before or at partially overlapped with the third step and/or the second step can be produced before or simultaneously with the first step without affecting the resulting antenna.

According to an embodiment of the invention in the first step the magnetic core produced includes the extension tabs described above, and preferably said extension tabs are produced including the terminal receiving configurations. In this case the attachment of the fifth step is produced by the insertion of the connection terminals in the receiving configurations defined in the terminal receiving configurations.

Optionally the extension tabs are produced also including said wire retention extensions where the ends of the conductive wires are wound around during the third step.

In an alternative embodiment the during the second step also a second soft-magnetic sheet is produced, and during the fourth step said first and second soft-magnetic sheets are attached to the magnetic core on opposite ends of the corner protuberances, defining the Z-winding channel. Preferably said first soft-magnetic sheet is produced including the terminal receiving configurations. In this case the attachment of the fifth step is produced by the insertion of the connection terminals in the receiving configurations defined in the terminal receiving configurations.

Optionally the first soft-magnetic sheet is produced also including said wire retention extensions where the ends of the conductive wires are wound around after the third step.

The present invention is directed, according to a second aspect of the invention, to a mobile phone that includes the ultra-low-profile triaxial low frequency antenna described in this document.

It is also proposed that the mobile phone further includes a mobile phone application for providing a user interface configured to control operation of the ultra-low-profile triaxial low frequency antenna.

Being the antenna a passive element when is configured as a reception antenna, a mobile phone including said antenna can be configured for receiving an electromagnetic signal through said antenna at any moment without requiring energy consumption. Also said reception of an electromagnetic signal, and also the emission of a signal using said antenna can be produced when the mobile phone is out of range of the telephone and internet signal.

Other features of the invention appear from the following detailed description of an embodiment.

BRIEF DESCRIPTION OF THE FIGURES

The foregoing and other advantages and features will be more fully understood from the following detailed description of an embodiment with reference to the accompanying drawings, to be taken in an illustrative and not limitative, in which.

DETAILED DESCRIPTION OF AN EMBODIMENT

Figure 1:
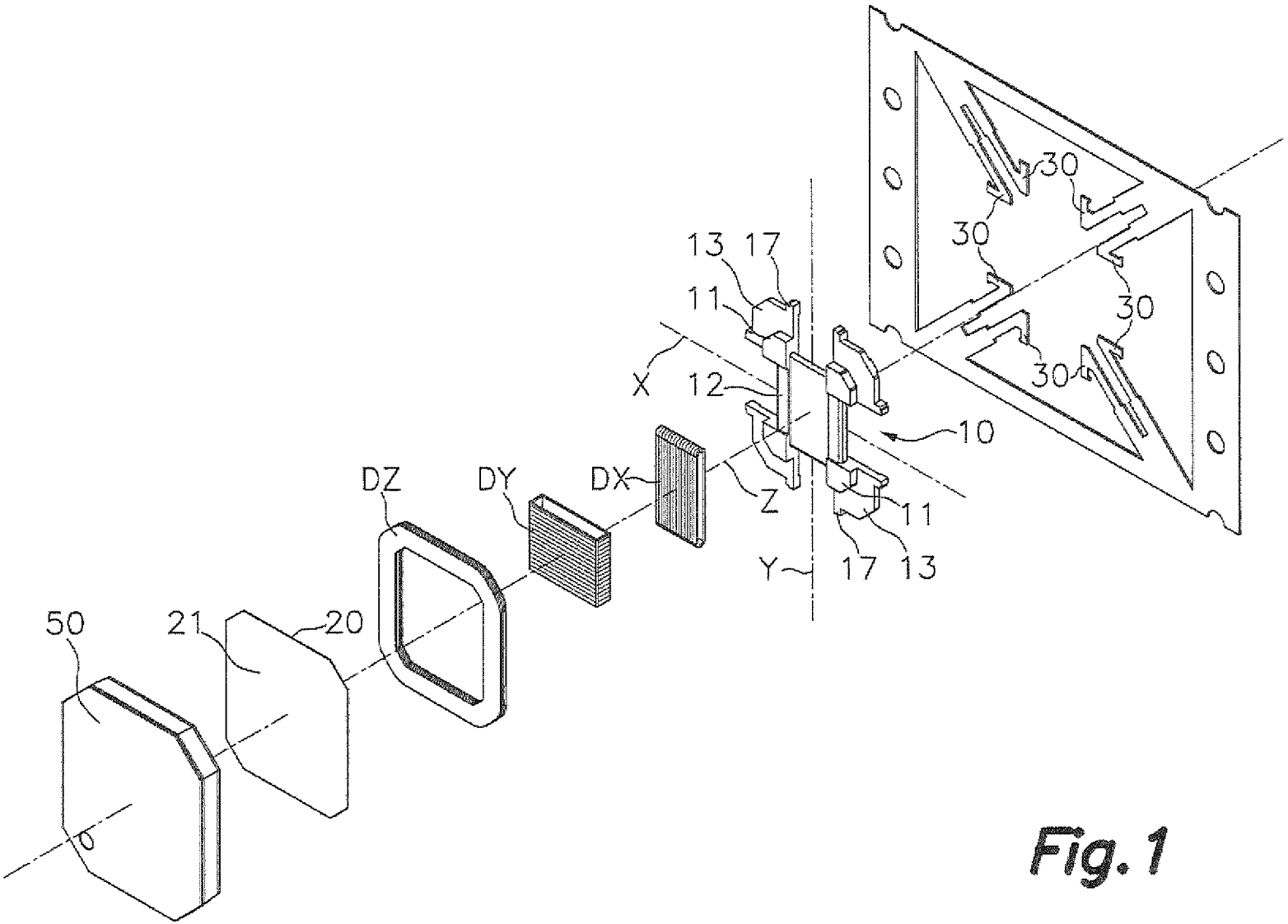
FIG. 1 shows an exploded view of the proposed ultra-low-profile triaxial low frequency antenna according to a first embodiment wherein the magnetic core includes four extension tabs, and including a lead frame.
Figure 3:
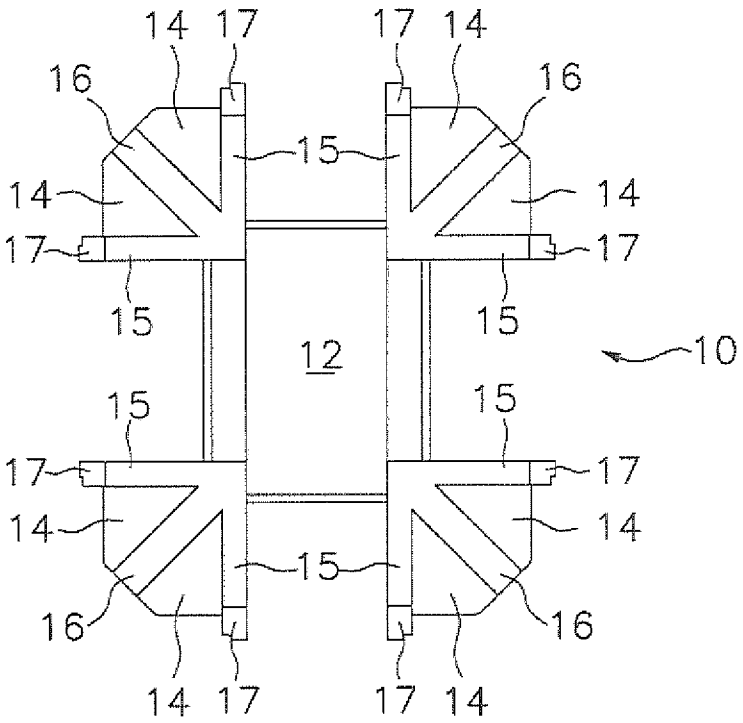
FIG. 3 shows a view of the reverse side of the magnetic core shown on FIG. 2.
Figure 2:
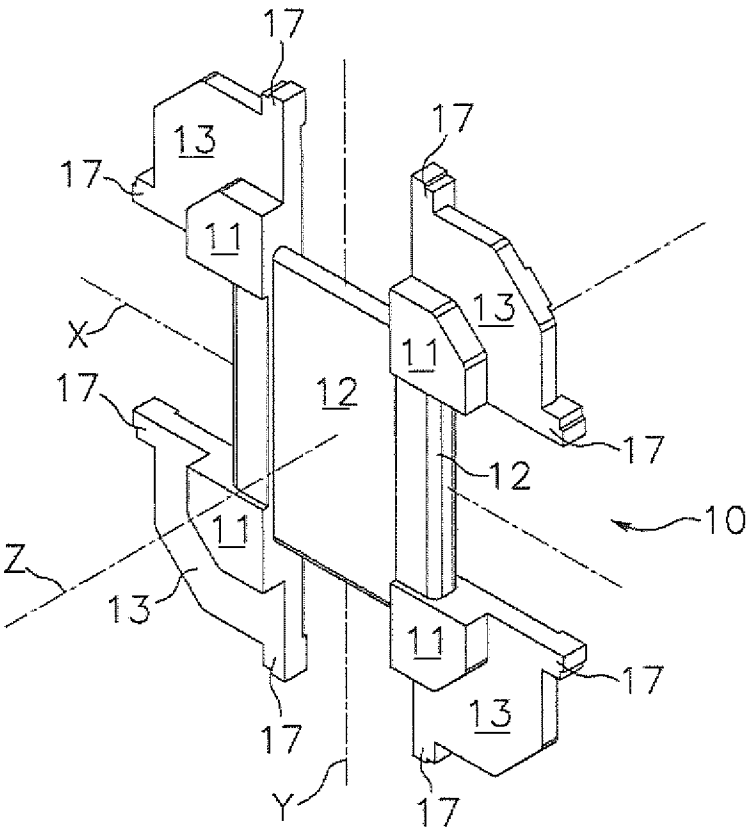
FIG. 2 shows a zoomed view of the magnetic core shown on FIG. 1.
Figure 5:
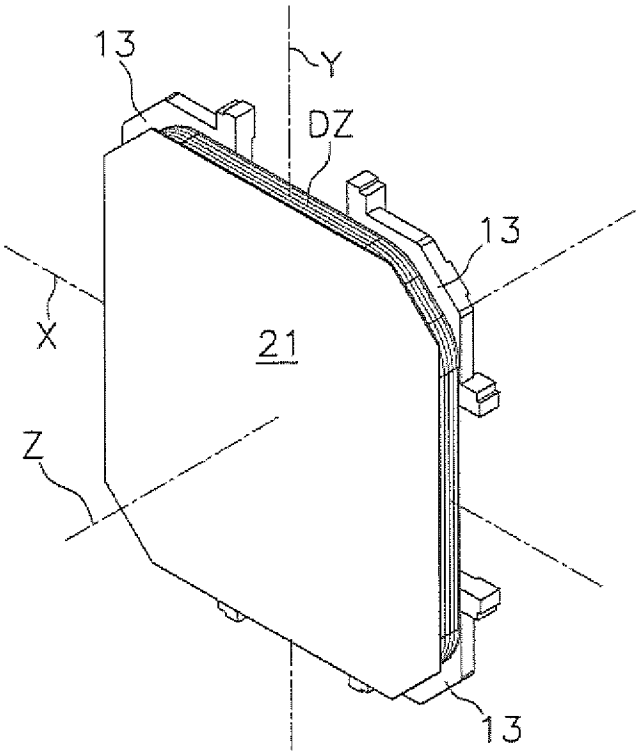
FIG. 5 shows the same antenna than FIG. 4 being the first soft-magnetic sheet attached to the magnetic core.
Figure 4:
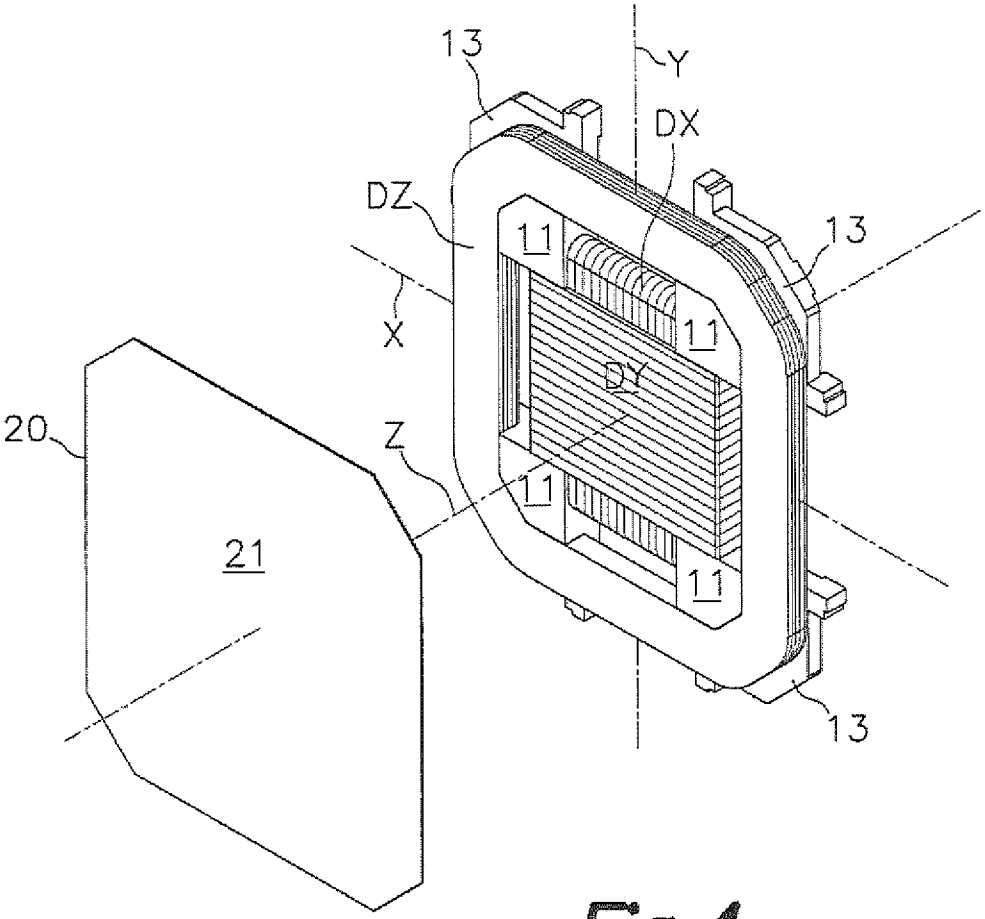
FIG. 4 shows a view of the antenna shown on FIG. 1 partially assembled, having the X-, Y- and Z-windings wound around the magnetic core and the first soft-magnetic sheet spaced apart thereon, and showing neither the lead frame nor the over-moulding.

The foregoing and other advantages and features will be more fully understood from the following detailed description of an embodiment with reference to the accompanying drawings, to be taken in an illustrative and not limitative, in which:

FIGS. 1 to 5 correspond to a first embodiment of the present invention in which the proposed ultra-low-profile triaxial low frequency antenna for integration in a mobile phone includes a magnetic core 10 with a complex shape obtained by an injection process and made of a soft-magnetic non-electro conductive material, preferably a Nickel Zinc alloy or a Manganese Zinc alloy.

Said magnetic core 10 has a general polygonal rectangular shape with six main faces which define three orthogonal axes, corresponding to an X-axis X, Y-axis Y and Z-axis Z. The Z-axis is perpendicular to the biggest main face.

Said magnetic core 10 also includes four corner protuberances 11 on its corners, each corner protuberance 11 protruding from the main faces of the magnetic core 10 in the X-axis and in the Y-axis directions, and also protruding on both opposed Z-axis directions.

Each corner protuberance 11 create a stepped configuration in regard to said main faces of the magnetic core 10, correspondent to a winding channel limiting edge, which faces another winding channel limiting edge of an opposed corner protuberance 11 defining there between a winding channel 12 around the magnetic core 10. Preferably said winding channel limiting edges create winding channels 12 at different levels on its intersections.

On this embodiment the magnetic core 10 is produced including an extension tab 13 protruding from each corner protuberance 11 in a direction perpendicular to the Z-axis Z. Said extension tabs 13 create a limiting edge for limiting the Z-winding.

Said extension tabs 13 further include, in a side opposed to the Z-winding, terminal receiving configurations 14 where connection terminals 30 can be attached. Said terminal receiving configurations 14 are eight in number, two coincident with each corner protuberance 13, comprising two orthogonal walls 15 and a spacing wall 16 defining said two terminal receiving configurations 14 where a semi-arrow end configurations of the connection terminal 30 are seated.

In addition, each extension tab 13 has been produced including two wire retention projections 17, one protruding in the X-axis direction and the other in the Y-axis direction. Each wire retention projections 17 is adjacent to one different terminal receiving configurations 14.

Three independent conductive wires are wound around the magnetic core 10, one wound in a winding channel around the X-axis defining the X-winding DX, other wound in a winding channel around the Y-axis defining the Y-winding DY, and the third wound around the corner protuberances 11 of the magnetic core 10 around the Z-axis defining the Z-winding DZ.

Preferably said Z-winding is wound using a self-adherent conductive coil, or other equivalent solution, producing a stable Z-winding DZ.

Each end of each conductive wire of each of said X-, Y- and Z-windings is wound around one different wire retention projections 17.

A flat and thin first soft-magnetic sheet 21 is produced by a tape cast process using ferrite material. Said first soft-magnetic sheet 21 is attached by adhesive to the magnetic core 10 in a position perpendicular to the Z-axis, being said first soft-magnetic sheet 21 in contact with the four corner protuberances 11. The size of the first soft-magnetic sheet 21 in the X- and Y-axis directions covers the Z-winding DZ with a limiting edge 20.

The perimeter region of the first soft-magnetic sheet 21, adjacent to said limiting edge 20, faces the Z-winding DZ, increasing the sensitivity of said Z-winding.

The extension tabs 13 faces said limiting edge 20 defining there between the winding channel 12 of the Z-winding DZ.

Figure 10:
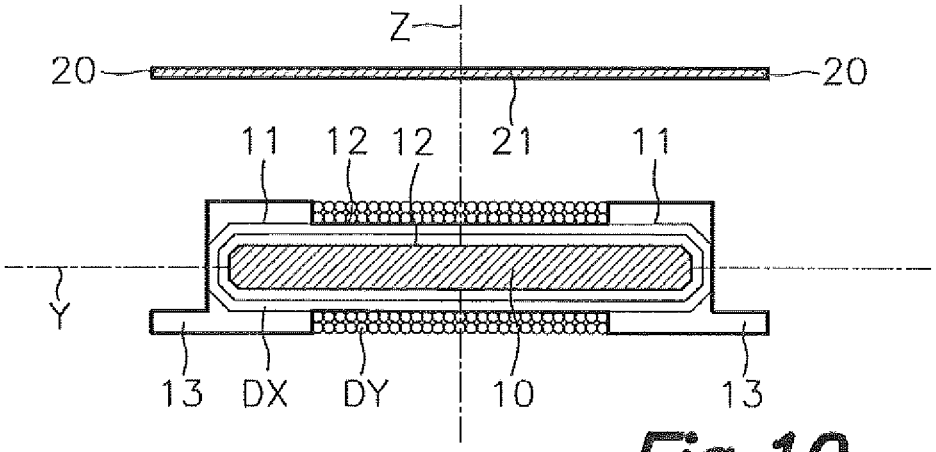
FIG. 10 shows the magnetic core of FIG. 9 with X-windings and Y-windings wound therearound.

As shown on FIG. 10, the X-winding DX and the Y-winding DY are wound around the magnetic core 10 before the adhesion of the first soft-magnetic sheet 21 on the magnetic core 10, performing the adhesion of the first soft-magnetic sheet 21 and the winding of the Z-winding DZ later.

Figure 11:
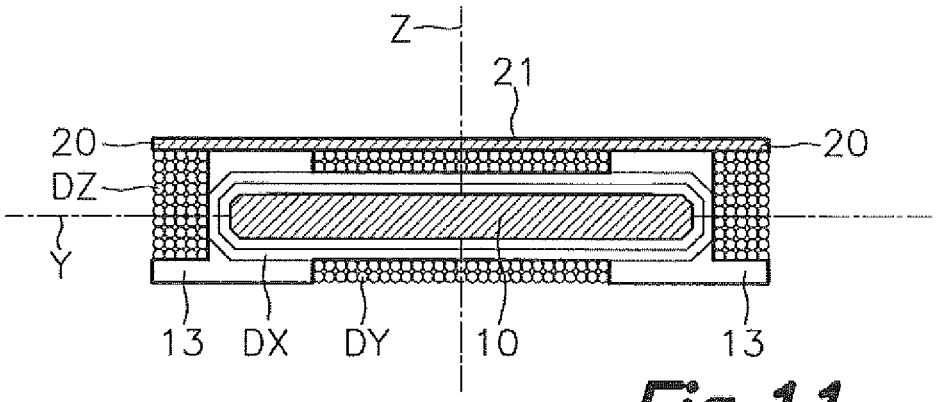
FIG. 11 shows magnetic core shown on FIG. 10, further including the first soft-magnetic sheet attached thereon and the Z-winding wound therearound.

As shown on FIG. 11, once the first soft-magnetic sheet 21 has been adhered on top of the corner protuberances 11 the winding channels 12 in which the X-winding DX and the Y-winding DY are wound becomes partially in a tunnel covered by said first soft-magnetic sheet 21 where said X-winding DX and Y-winding DY are confined between the magnetic core 10 and the first soft-magnetic sheet 21. This configuration also provides for a maximum height for the Z-winding DZ in the Z axis direction.

A lead frame 40, which is a die-cut frame defining a hollow central region with eight connector terminals 30 projecting from the frame to the hollow centre of the lead frame 40, is provided.

Once the magnetic core 10 with the X-, Y- and Z-windings wound around includes the first soft-magnetic sheet 21, it is attached to said connector terminals 30 integrated in a lead frame 40 by placing said attachment in the central region of the lead frame, inserting each connector terminal end to one of said terminal receiving configurations 14 provided in the extension tabs 13.

The insertion of said connector terminals on said terminal receiving configurations 14 produces the electric contact of each connector terminal 30 with one different wire end wound around one wire retention projection 17. A welding operation will be then performed, for example by a laser beam.

The resulting element is then over-moulded with epoxy resin creating an electro-insulating casing 50 covering the magnetic core 10, the first soft-magnetic sheet 21 and the three orthogonal windings DX, DY, DZ, but not covering part of said contact terminals 30.

Figure 7:
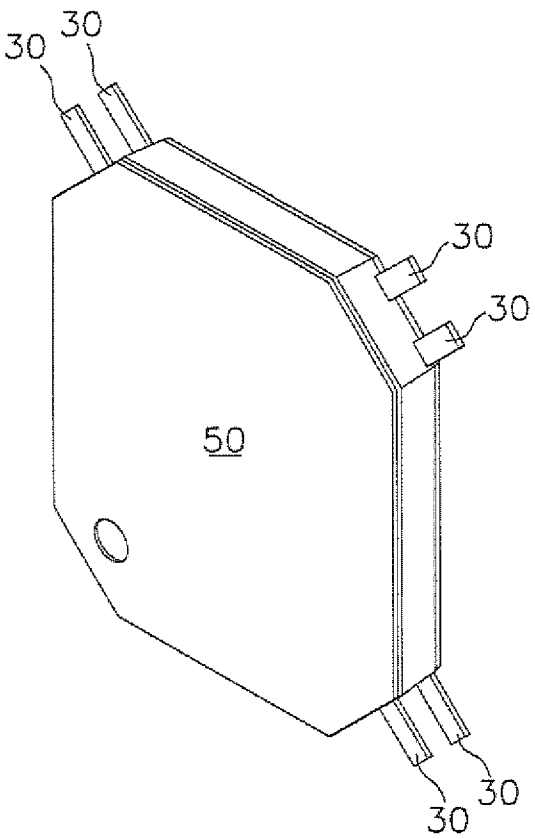
FIG. 7 shows a complete antenna, including the electro-insulant over-moulding, and the connector terminals exiting from said electro-insulant over-moulding.

Cutting the connection terminals 30 from the lead frame 40 complete the production of the proposed antenna, obtaining the antenna shown on FIG. 7.

Figure 6:
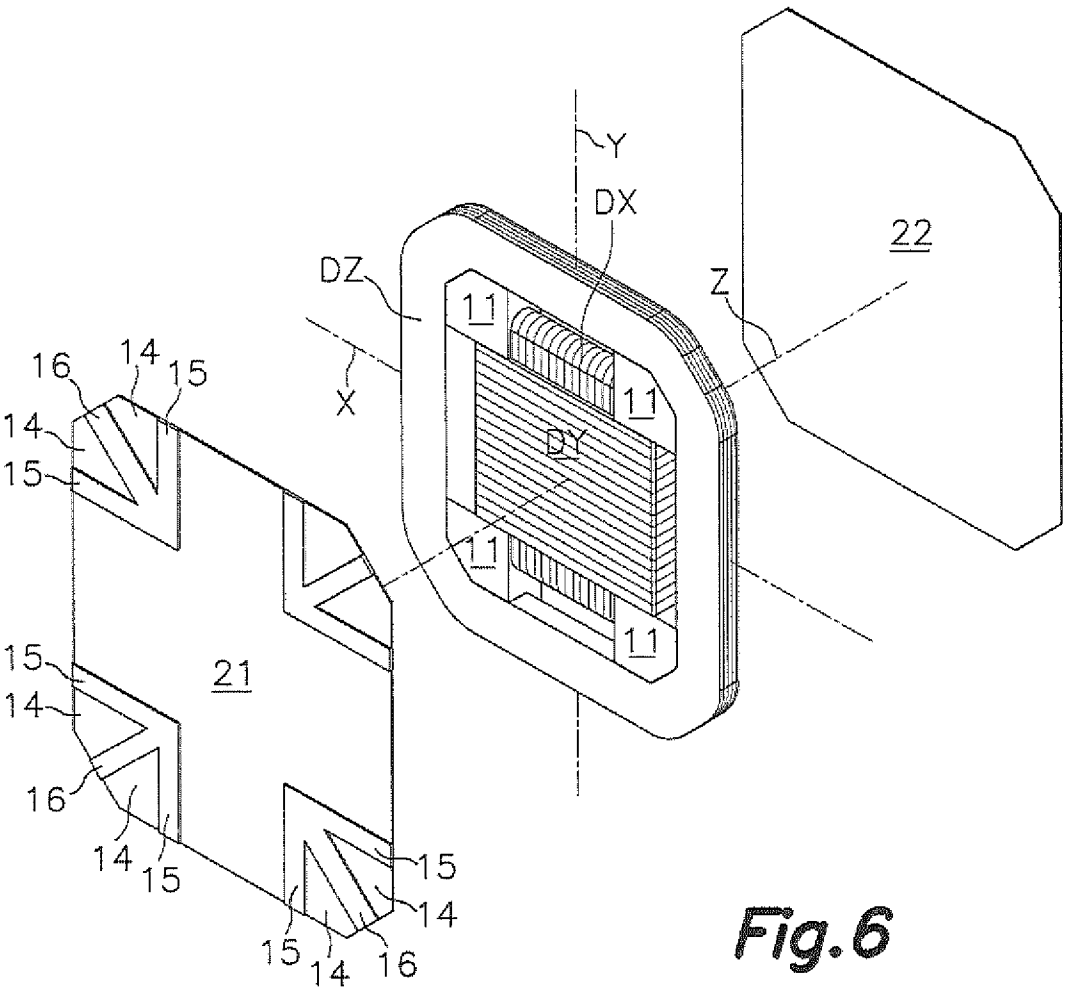
FIG. 6 shows an alternative embodiment of the antenna wherein the magnetic core does not have extension tabs and wherein there is are first and second soft-magnetic sheets on opposite sides of the magnetic core.

FIG. 6 shows an alternative embodiment of this invention similar to the previously described embodiment, but in which the magnetic core 10 does not include said extension tabs 13, and in which the terminal receiving configurations 14 and the wire retention projection 17 are integrated in the first soft-magnetic sheet 21, for example moulded together or added by material deposition or 3D printed thereon.

An additional difference with the previous embodiment is that a second soft-magnetic sheet 22 is added to the magnetic core 10 opposed to the position of the first soft-magnetic sheet 21, containing there between the magnetic core 10 and limiting the Z-winding channel.

Figure 8:
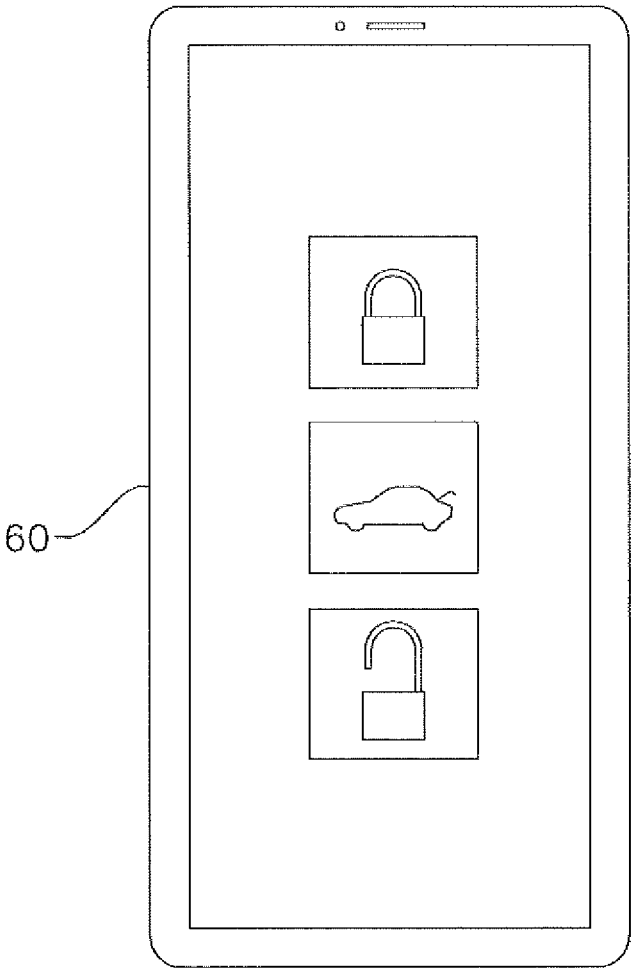
FIG. 8 shows a mobile phone including the proposed ultra-low-profile triaxial low frequency antenna and further including a mobile phone software application for providing a user interface configured to control operation of the ultra-low-profile triaxial low frequency antenna to operate a key-less system.
Figure 9:
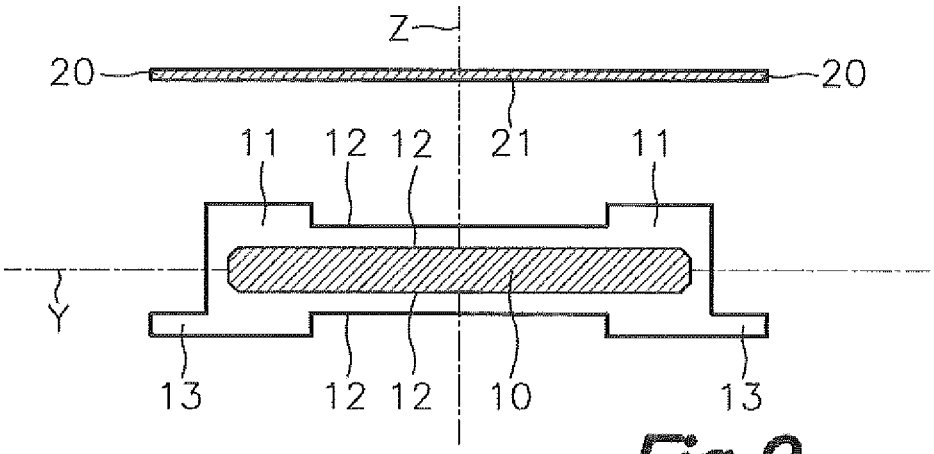
FIG. 9 shows a transverse section of the magnetic core and of the first soft-magnetic sheet spaced apart thereon, according to a first embodiment.

Finally, FIG. 8 shows a mobile phone 60 including the proposed ultra-low-profile triaxial low frequency antenna and further including a mobile phone software application for providing a user interface configured to control operation of the ultra-low-profile triaxial low frequency antenna to operate a key-less system, in this embodiment for open and close a car and its trunk.

It will be understood that various parts of one embodiment of the invention can be freely combined with parts described in other embodiments, even being said combination not explicitly described, provided there is no harm in such combination.

The invention claimed is:

1. Ultra-low-profile triaxial low frequency antenna for integration in a mobile phone, comprising:

a magnetic core, made of a soft-magnetic non-electro conductive material, including four corner protuberances defining two orthogonal winding channels around the magnetic core;

X-winding (DX), Y-winding (DY) and Z-winding (DZ) of conductive wire orthogonal to one another wound around X-axis, Y-axis and Z-axis (X, Y, Z) orthogonal to each other surrounding said magnetic core, the X-winding (DX) and the Y-winding (DY) being arranged in said two winding channels of the magnetic core and the Z-winding (DZ) being arranged surrounding the four corner protuberances, such that when an electromagnetic field cross over the mentioned X- Y- and Z-windings (DX, DY, DZ), an electric potential is generated between each wire ends;

wherein each of the X-, Y- and Z-windings (DX, DY, DZ) has a conductive wire entry and a conductive wire exit connected to a respective connection terminal, wherein the antenna further comprises a first soft-magnetic sheet perpendicular to the Z-axis (Z) and attached to flat faces of the four corner protuberances of the magnetic core, said flat faces being perpendicular to the Z-axis (Z) and protruding from the winding channels in a side facing the first soft-magnetic sheet (21), the X winding (DX) and the Y winding (DY) wound in said winding channels becoming partially covered by said first soft magnetic sheet, whereby the X winding (DX) and the Y winding (DY) are confined between a side of the magnetic core facing the first soft-magnetic sheet and the first soft magnetic sheet; and the first soft-magnetic sheet has a size in the X- and Y-axis directions that covers the Z-winding DZ providing a limiting edge for the Z-winding (DZ); so that an increase of the sensitivity of the Z-winding (DZ) and a reduced thickness of the antenna in the Z-axis (Z) direction are obtained.

2. The ultra-low-profile triaxial low frequency antenna of claim 1, wherein each of the four corners protuberances of the magnetic core include an extension tab perpendicular to the Z-axis (Z), defining along with said limiting edge a Z-winding channel housing said Z-winding (DZ).

3. The ultra-low-profile triaxial low frequency antenna of claim 2, wherein said connection terminals are attached to said extension tabs, each extension tab including, in a side opposed to the Z-winding channel, terminal receiving configurations where the connection terminals are attached.

4. The ultra-low-profile triaxial low frequency antenna of claim 3, wherein said terminal receiving configurations are eight in number, two coincident with each corner protuberance, comprising two orthogonal walls and a spacing wall defining said two terminal receiving configurations where semi-arrow end configurations of the connection terminal are seated.

5. The ultra-low-profile triaxial low frequency antenna of claim 2, wherein said extension tab and/or the limiting edge extends beyond the projection of the Z-winding (DZ), contributing to increase the antenna sensitivity due to an enlarged cross section in regard to the Z-axis (Z).

6. The ultra-low-profile triaxial low frequency antenna of claim 1, wherein the antenna includes a second soft-magnetic sheet perpendicular to the Z-axis (Z) and attached superimposed on said four corner protuberances of the magnetic core in opposition to the first soft-magnetic sheet, being the magnetic core confined between the first and second soft-magnetic sheets, defining along with said limiting edge a Z-winding channel housing said Z-winding (DZ).

7. The ultra-low-profile triaxial low frequency antenna of claim 6, wherein said first soft-magnetic sheet and/or said second soft-magnetic sheet extending beyond the projection of the Z-winding (DZ), contributing to increase the antenna sensitivity due to an enlarged cross section in regard to the Z-axis (Z).

8. The ultra-low-profile triaxial low frequency antenna of claim 6, wherein said connection terminals are attached to said first soft-magnetic sheet which includes, in a side opposed to the Z-winding, a terminal receiving configurations where the connection terminals are attached.

9. The ultra-low-profile triaxial low frequency antenna of claim 1, wherein the thickness of the antenna in the Z-axis (Z) direction is equal or less than 1.65 mm and/or wherein said first soft-magnetic sheet is thinner than 0.1 mm.

10. The ultra-low-profile triaxial low frequency antenna of claim 9 wherein said first soft-magnetic sheet is thinner than 0.05 mm.

11. The ultra-low-profile triaxial low frequency antenna of claim 1, wherein the extension of the antenna in the X-axis and in the Y-axis directions is equal or less than 196 $mm^2$.

12. The ultra-low-profile triaxial low frequency antenna of claim 1, wherein the magnetic core is a high density injected ferrite core, or a high density injected ferrite core made of a Nickel Zinc alloy or a high density injected ferrite core made of a Manganese Zinc alloy.

13. The ultra-low-profile triaxial low frequency antenna of claim 1, wherein the first soft-magnetic sheet is a tape cast ferrite sheet.

14. The ultra-low-profile triaxial low frequency antenna of claim 1, wherein the magnetic core shape is at least partially defined by stepped configurations, some of said stepped configurations having a height of 0.1 mm or less.

15. The ultra-low-profile triaxial low frequency antenna of claim 1, wherein the first soft-magnetic sheet has a central hole in a central region which size and position regulates the sensitivity, quality factor and inductance of the X-, Y- and Z-windings of the antenna.

16. A mobile phone comprising an ultra-low-profile triaxial low frequency antenna according to claim 1 to operate a key-less system.

17. The mobile phone according to claim 16 further comprising a mobile phone software application for providing a user interface configured to control operation of the ultra-low-profile triaxial low frequency antenna.

18. Ultra-low-profile triaxial low frequency antenna for integration in a mobile phone, including:

a magnetic core, made of a soft-magnetic non-electro conductive material, defining X-axis, Y-axis and Z-axis (X, Y, Z), orthogonal to each other, the magnetic core including there around two orthogonal winding channels, one around the X-axis and one around the Y-axis, delimited between four corner protuberances of the magnetic core;

an X-winding (DX) of conductive wire wound around the X-axis, surrounding the magnetic core and arranged in one of the two orthogonal winding channels;

a Y-winding (DY) of conductive wire wound around the Y-axis, surrounding the magnetic core and arranged in the other of the two orthogonal winding channels;

a Z-winding (DZ) of conductive wire wound around the Z-axis, surrounding the four corner protuberances of the magnetic core;

a first soft-magnetic sheet perpendicular to the Z-axis (Z) and superimposed to, and in contact with, the four corner protuberances of the magnetic core, a portion of the two orthogonal winding channels, and a portion of the X winding (DX) and the Y winding (DY) contained therein, being comprised between a portion of the first soft-magnetic sheet and a side of the magnetic core facing the first soft-magnetic sheet, and wherein the first soft-magnetic sheet extends in the X-axis and Y-axis directions defining a limiting edge which projection, in the Z-axis direction, surrounds the Z winding, providing an increase of the sensitivity of the Z winding (DZ) and a reduced thickness of the antenna in the Z-axis (Z) direction.

* * * * *